US012584277B2

(12) United States Patent
Weigel

(10) Patent No.: US 12,584,277 B2
(45) Date of Patent: Mar. 24, 2026

(54) CONSTANT SURFACE PATTERNS DURING SLIP FORM PAVING

(71) Applicant: Wirtgen GmbH, Windhagen (DE)

(72) Inventor: Christoph Weigel, Sankt Augustin (DE)

(73) Assignee: Wirtgen GmbH, Windhagen (DE)

( * ) Notice: Subject to any disclaimer, the term of this patent is extended or adjusted under 35 U.S.C. 154(b) by 510 days.

(21) Appl. No.: 18/365,592

(22) Filed: Aug. 4, 2023

(65) Prior Publication Data

US 2025/0043520 A1 Feb. 6, 2025

(51) Int. Cl.
*E01C 19/43* (2006.01)
*E01C 19/48* (2006.01)

(52) U.S. Cl.
CPC ..... *E01C 19/43* (2013.01); *E01C 19/484* (2013.01)

(58) Field of Classification Search
CPC ..... E01C 19/40; E01C 19/405; E01C 19/43; E01C 19/484
USPC ..... 404/105
See application file for complete search history.

(56) References Cited

U.S. PATENT DOCUMENTS

| | | | |
|---|---|---|---|
| 3,605,579 | A | 9/1971 | Heltzel |
| 3,850,541 | A | 11/1974 | Baillet et al. |
| 4,798,495 | A | 1/1989 | Laeuppi et al. |
| 5,101,360 | A | 3/1992 | Bennett |
| 5,190,397 | A | 3/1993 | Bengford et al. |
| 5,209,602 | A | 5/1993 | Godbersen |
| 5,405,212 | A | 4/1995 | Swisher et al. |
| 5,568,992 | A | 10/1996 | Grembowicz et al. |
| 5,588,776 | A | 12/1996 | Swisher, Jr. et al. |

(Continued)

FOREIGN PATENT DOCUMENTS

| | | | |
|---|---|---|---|
| CN | 116170562 | A | 5/2023 |
| EP | 0493664 | A1 | 7/1992 |

(Continued)

OTHER PUBLICATIONS

D. Castro-Lacourute and L. S. Bryson, C. Maynard, R. L. Williams II and P. Bosscher, Concrete Paving Productivity Improvement Using a Multi-Task Autonomous Robot, 24th International Symposium on Automation & Robotics in Construction (ISARC 2007) Construction Automation Group, I.I.T. Madras, 7 pages.

(Continued)

*Primary Examiner* — Gary S Hartmann
(74) *Attorney, Agent, or Firm* — Lucian Wayne Beavers; Lucian Wayne Beavers

(57) ABSTRACT

A slip form paving machine includes a slip form mold having a mold width extending transversely to a paving direction. At least one smoothing beam is supported behind the slip form mold for engaging an upper surface of a formed not yet hardened concrete structure to smooth the upper surface, the at least one smoothing beam being configured to oscillate transversely to the paving direction. At least one advance speed sensor is configured to provide an advance speed signal corresponding to an advance speed of the slip form paving machine in the paving direction. A controller is configured to receive the advance speed signal and to generate a command signal to control a frequency of transverse oscillation of the at least one smoothing beam such that a constant relationship is maintained between the advance speed and the frequency of transverse oscillation.

19 Claims, 7 Drawing Sheets

(56) References Cited

U.S. PATENT DOCUMENTS

| | | | | |
|---|---|---|---|---|
| 5,924,817 | A | 7/1999 | Godbersen | |
| 5,941,659 | A | 8/1999 | Godbersen | |
| 6,027,282 | A * | 2/2000 | Horn | G01C 15/004 404/75 |
| 6,176,643 | B1 | 1/2001 | Guntert et al. | |
| 6,238,135 | B1 * | 5/2001 | Rower | E01C 19/48 404/133.05 |
| 6,390,726 | B1 | 5/2002 | Guntert et al. | |
| 6,390,727 | B1 | 5/2002 | Guntert et al. | |
| 6,471,442 | B1 | 10/2002 | Deeb et al. | |
| 6,597,037 | B1 | 7/2003 | Forbes et al. | |
| 6,655,869 | B1 | 12/2003 | Deeb et al. | |
| 6,872,028 | B2 | 3/2005 | Aeschlimann et al. | |
| 7,037,035 | B2 | 5/2006 | Casters | |
| 7,136,522 | B2 | 11/2006 | Harrington et al. | |
| 8,382,396 | B2 | 2/2013 | Francis et al. | |
| 8,613,566 | B2 | 12/2013 | Fritz et al. | |
| 8,989,968 | B2 | 3/2015 | Fritz et al. | |
| 9,039,322 | B2 | 5/2015 | Francis et al. | |
| 9,051,696 | B1 | 6/2015 | Coats et al. | |
| 9,096,977 | B2 | 8/2015 | Fritz et al. | |
| 9,359,726 | B2 | 6/2016 | Francis et al. | |
| 9,395,726 | B1 | 7/2016 | Rizzi et al. | |
| 9,404,228 | B1 | 8/2016 | Coats et al. | |
| 9,551,115 | B2 | 1/2017 | Engels et al. | |
| 10,132,046 | B2 | 11/2018 | Thieme et al. | |
| 10,253,461 | B2 | 4/2019 | Engels et al. | |
| 10,407,845 | B1 * | 9/2019 | Downing | E01C 19/4853 |
| 10,738,421 | B2 | 8/2020 | Guntert, Jr. et al. | |
| 10,982,396 | B2 | 4/2021 | Fritz | |
| 11,060,247 | B2 * | 7/2021 | Schuette | E01C 19/48 |
| 11,193,244 | B2 | 12/2021 | Guntert, Jr. et al. | |
| 12,473,698 | B2 * | 11/2025 | Engels | E01C 19/40 |
| 2001/0041094 | A1 | 11/2001 | Guntert, Jr. et al. | |
| 2002/0168226 | A1 | 11/2002 | Feucht et al. | |
| 2006/0204334 | A1 | 9/2006 | Guntert et al. | |
| 2010/0150650 | A1 | 6/2010 | Buschmann et al. | |
| 2015/0139730 | A1 | 5/2015 | Buschmann et al. | |
| 2016/0115654 | A1 | 4/2016 | Pedersen et al. | |
| 2016/0177519 | A1 | 6/2016 | Fritz et al. | |
| 2025/0012022 | A1 * | 1/2025 | Engels | E01C 19/40 |

FOREIGN PATENT DOCUMENTS

| | | | | |
|---|---|---|---|---|
| EP | 2325392 | A2 | 5/2011 | |
| EP | 3798361 | B1 * | 5/2024 | E01C 19/4866 |

OTHER PUBLICATIONS

European Office Action for corresponding patent application No. 24192649.2, dated Dec. 17, 2024, 5 pages (not prior art).

* cited by examiner

CONSTANT SURFACE PATTERNS DURING SLIP FORM PAVING

FIELD OF THE DISCLOSURE

The present disclosure relates to a slip form paving machine and a method for controlling the slip form paving machine so as to provide more consistent surface finishes on a formed concrete structure.

BACKGROUND

One phenomenon encountered during slip form paving of concrete structures when using a smoothing beam behind a slip form mold is that the oscillation of the smoothing beam on the upper surface of the newly formed concrete structure will form patterns in the upper surface. The structure of these patterns is dependent upon the advance speed of the paving machine and on the oscillation frequency of the smoothing beam. In prior art paving machines, the oscillation frequencies of a transverse smoothing beam and/or a longitudinal smoothing beam are set manually and thus as the advance speed of the paving machine changes the patterns formed on the upper surface change. These changing patterns lead to inconsistent surface finishes.

These and other problems are addressed by the present disclosure.

SUMMARY OF THE DISCLOSURE

In one embodiment a slip form paving machine includes a machine frame and a plurality of ground engaging wheels or tracks for supporting the machine frame from a ground surface. A slip form mold is supported from the machine frame for molding a mass of concrete into a formed not yet hardened concrete structure as the paving machine moves forward in a paving direction, the slip form mold having a mold width extending transversely to the paving direction. At least one smoothing beam is supported behind the slip form mold for engaging an upper surface of the formed not yet hardened concrete structure to smooth the upper surface, the at least one smoothing beam being configured to oscillate transversely to the paving direction. At least one advance speed sensor is configured to provide an advance speed signal corresponding to an advance speed of the slip form paving machine in the paving direction. A controller is configured to receive the advance speed signal and to generate a command signal to control a frequency of transverse oscillation of the at least one smoothing beam such that a constant relationship is maintained between the advance speed and the frequency of transverse oscillation.

The at least one smoothing beam may include a transverse smoothing beam having an elongated shape with a longest dimension extending transversely across at least a majority of the mold width.

In the above embodiment a transverse oscillation frequency sensor may be configured to provide a transverse oscillation frequency signal corresponding to the frequency of transverse oscillation of the transverse smoothing beam.

In the above embodiment the slip form paver machine may further include a drive motor rotatably driving an eccentric drive connected to the transverse smoothing beam to generate the transverse oscillation of the transverse smoothing beam and the transverse oscillation frequency sensor may be configured to detect a rotational speed of the drive motor.

In any of the above embodiments the at least one smoothing beam may further include a longitudinal smoothing beam having an elongated shape with a longest dimension extending parallel to the paving direction.

In the above embodiment the longitudinal smoothing beam may also oscillate parallel to the paving direction while it oscillates transversely to the paving direction, and the controller may be further configured to generate a command signal to control a frequency of longitudinal oscillation of the longitudinal smoothing beam such that a constant relationship between the advance speed and the frequency of longitudinal oscillation is maintained.

Any of the above embodiments may further include a transverse oscillation frequency sensor configured to provide a transverse oscillation frequency signal corresponding to the frequency of transverse oscillation of the longitudinal smoothing beam and a longitudinal oscillation frequency sensor configured to provide a longitudinal oscillation frequency signal corresponding to the frequency of longitudinal oscillation of the longitudinal smoothing beam. The controller may be further configured to receive the transverse oscillation frequency signal and the longitudinal oscillation frequency signal.

In the above embodiment the slip form paving machine may further include at least one winch configured to pull a carriage carrying the longitudinal smoothing beam left and right across the mold width and the transverse oscillation frequency sensor may be configured to detect a rotational speed of the at least one winch.

In either of the two immediately above embodiments the slip form paver machine may further include a drive motor rotatably driving an eccentric drive connected to the longitudinal smoothing beam to generate the longitudinal oscillation of the longitudinal smoothing beam and the longitudinal oscillation frequency sensor may be configured to detect a rotational speed of the drive motor.

In any of the above embodiments the slip form paver machine may further include a transverse oscillation frequency sensor configured to provide a transverse oscillation frequency signal corresponding to a frequency of transverse oscillation of the at least one smoothing beam.

In any of the above embodiments the mold width of the slip form mold may be an adjustable mold width.

In a further embodiment, a method of operating a slip form paving machine including a slip form mold may include steps of: (a) molding a mass of concrete with the slip form mold to form a not yet hardened concrete structure as the paving machine moves forward in a paving direction; (b) engaging an upper surface of the not yet hardened concrete structure with at least one smoothing beam supported behind the slip form mold and oscillating the at least one smoothing beam transversely to the paving direction to smooth the upper surface; (c) monitoring an advance speed of the slip form paving machine with a controller; and (d) automatically controlling with the controller a frequency of transverse oscillation of the at least one smoothing beam such that a constant relationship is maintained between the advance speed and the frequency of transverse oscillation thereby forming a constant surface pattern on the upper surface of the not yet hardened concrete structure.

In the above method in step (b) the at least one smoothing beam may include a transverse smoothing beam having an elongated shape with a longest dimension extending transversely across at least a majority of a mold width of the slip form mold.

In the above method in step (b) the at least one smoothing beam may further include a longitudinal smoothing beam having an elongated shape with a longest dimension extending parallel to the paving direction, the longitudinal smoothing beam being located behind the transverse smoothing beam.

In the above method step (b) may further include oscillating the longitudinal smoothing beam parallel to the paving direction while the longitudinal smoothing beam oscillates transversely to the paving direction and step (d) may further include automatically controlling with the controller a frequency of longitudinal oscillation of the longitudinal smoothing beam such that a constant relationship is maintained between the advance speed and the frequency of longitudinal oscillation.

In the first method embodiment above, in step (b) the at least one smoothing beam may include a longitudinal smoothing beam having an elongated shape with a longest dimension extending parallel to the paving direction.

In the above method step (b) may further include oscillating the longitudinal smoothing beam parallel to the paving direction while the longitudinal smoothing beam oscillates transversely to the paving direction and step (d) may further include automatically controlling with the controller a frequency of longitudinal oscillation of the longitudinal smoothing beam such that a constant relationship is maintained between the advance speed and the frequency of longitudinal oscillation.

Numerous objects, features and advantages of the present invention will be readily apparent to those skilled in the art upon a review of following description in conjunction with the accompanying drawings.

DETAILED DESCRIPTION

The embodiments of the present disclosure described below are not intended to be exhaustive or to limit the disclosure to the precise forms disclosed in the following detailed description. Rather, the embodiments are chosen and described so that others skilled in the art may appreciate and understand the principles and practices of the present disclosure.

Figure 1:
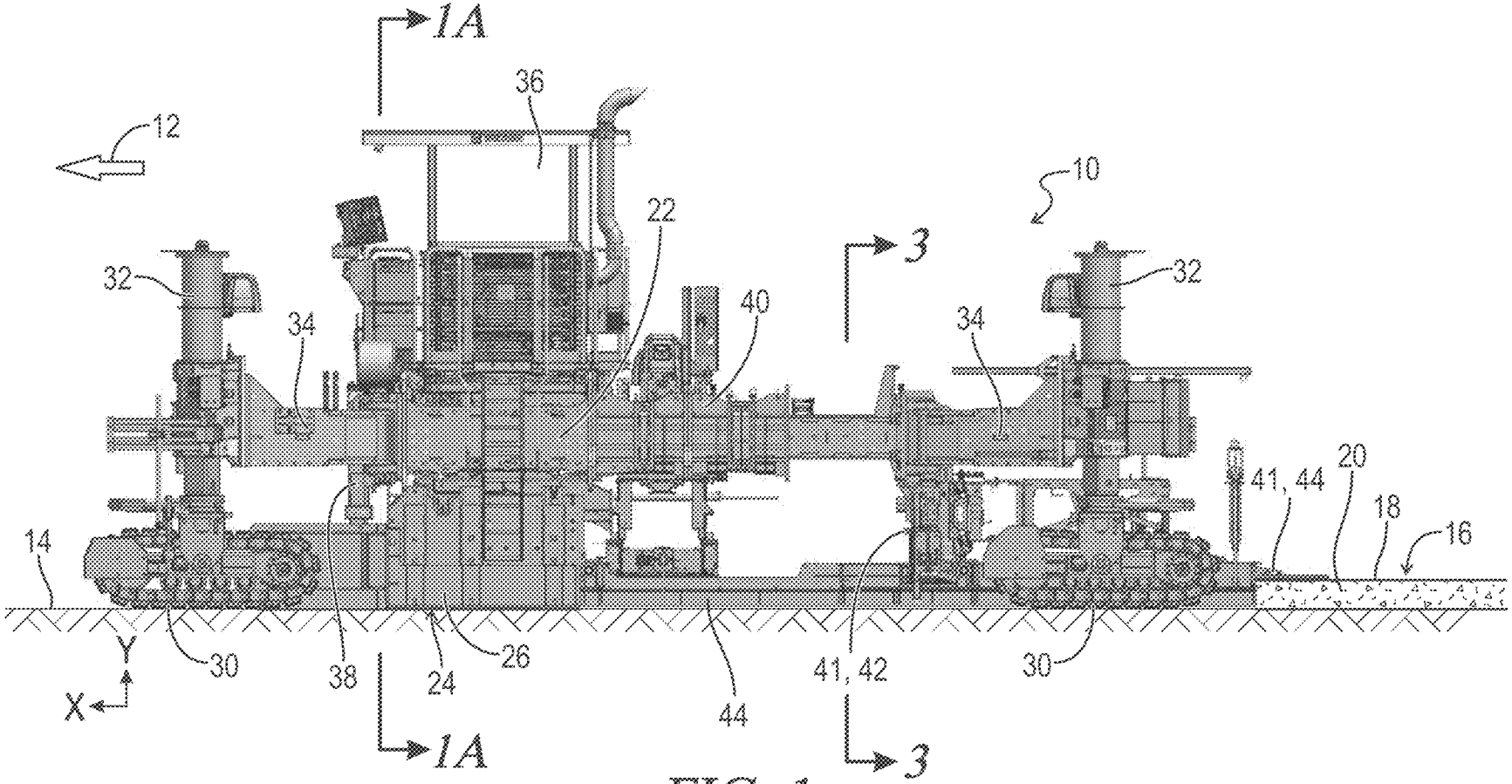
FIG. 1 is a left side elevation view of a slip form paver.

Referring now to the drawings and particularly to FIG. 1, a slip form paver machine is shown and generally designated by the number 10. The machine 10 is configured to move in a paving direction 12 across a ground surface 14 for spreading, leveling and finishing concrete into a formed but not yet hardened concrete structure 16 having a generally upwardly exposed upper surface 18 and terminating in lateral concrete sides such as 20.

The slip form paver machine 10 includes a main frame 22 and a slip form paver mold 24, which may also be referred to as a slip form mold 24, supported from the main frame 22. Left and right side form assemblies 26 and 28 are connected to the slip form paver mold 24 to close the slip form paver mold 24 on the left and right sides to form the lateral concrete sides such as 20 of the finished concrete structure 16.

Figure 1A:
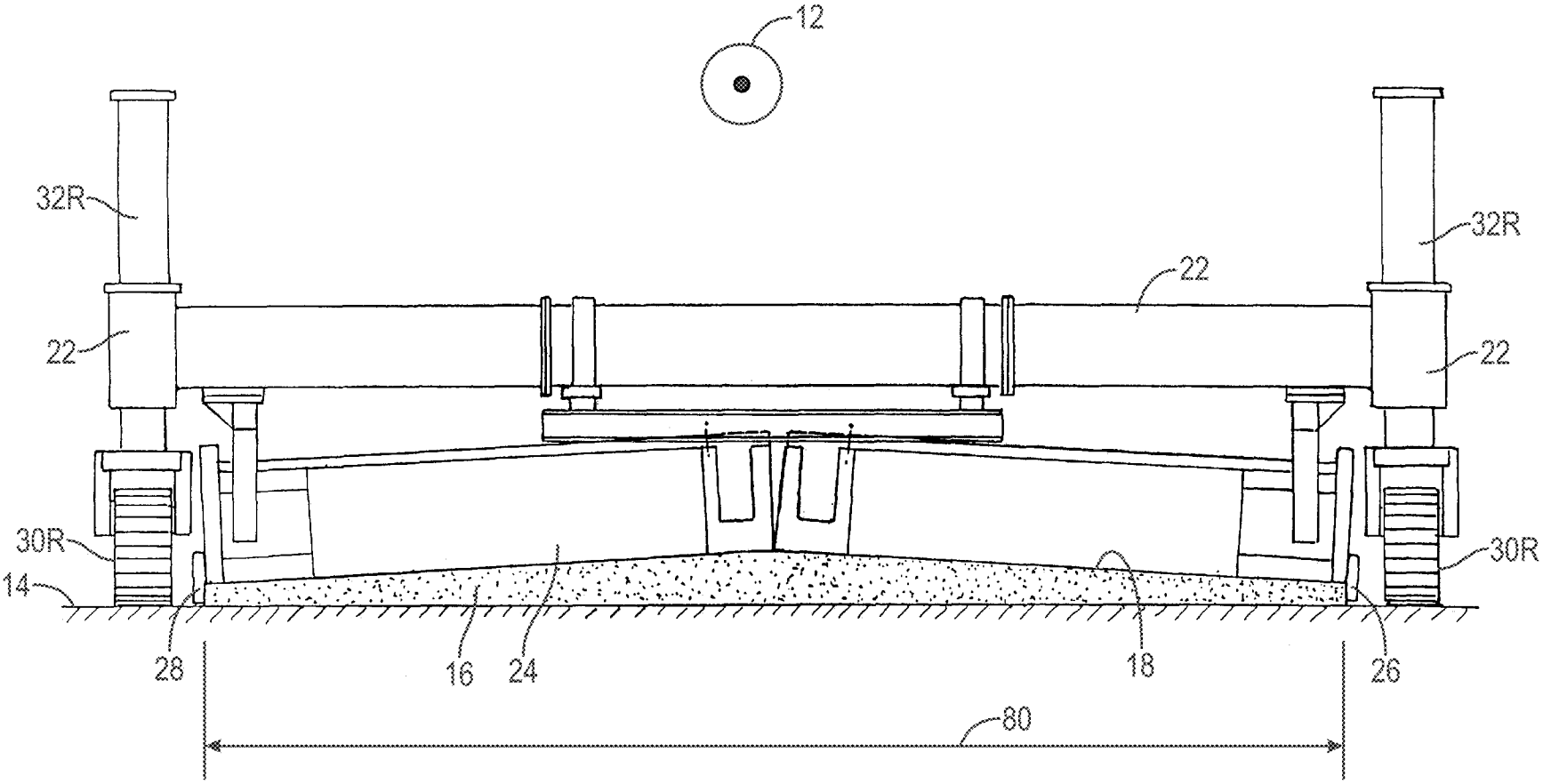
FIG. 1A is a schematic front elevation sectioned view taken along line 1A-1A of FIG. 1 and showing a front elevation of a slip form mold of the slip form paver of FIG. 1.

As best seen in FIG. 1A, the slip form mold 24 has a mold width 80 between the side form assemblies 26 and 28. The mold width 80 also corresponds to the width of the concrete structure 16 formed by the mold, which width is indicated by the number 81 in FIG. 3. The slip form mold 24 may be an adjustable width slip form mold as is known in the art, but it will be understood that for any given paving job the mold width 80 will be adjusted to a desired width and then the mold width 80 will remain fixed during the paving operation.

The main frame 22 is supported from the ground surface by a plurality of ground engaging units such as 30, which in the illustrated embodiment are tracked ground engaging units 30. Wheeled ground engaging units may also be used. Each of the ground engaging units 30 is connected to the main frame 22 by a lifting column such as 32 which is attached to a swing arm such as 34. An operator's station 36 is located on the main frame 22. As used herein the terms left and right are from the viewpoint of a human operator located on the operator's station 36 and facing forward in the paving direction 12. A plow or spreader device 38 is supported from the main frame 22 ahead of the slip form paver mold 24. A spreading auger 39 may be used instead of the plow 38. Behind the slip form paver mold 24 a dowel bar inserter apparatus 40 may be provided.

At least one smoothing beam 41 may be supported behind the slip form mold 24 for engaging the upper surface 20 of the formed but not yet hardened concrete structure to smooth the upper surface 20. The at least one smoothing beam 41 is configured to oscillate transversely to the paving direction 12. The at least one smoothing beam may include a transverse smoothing beam 42 and/or a longitudinal smoothing beam 44. The transverse smoothing beam 42 is often referred to by those skilled in the art as an "oscillating beam" 42. The longitudinal smoothing beam 44 is often referred to by those skilled in the art as a "super smoother" 44.

Figure 2:
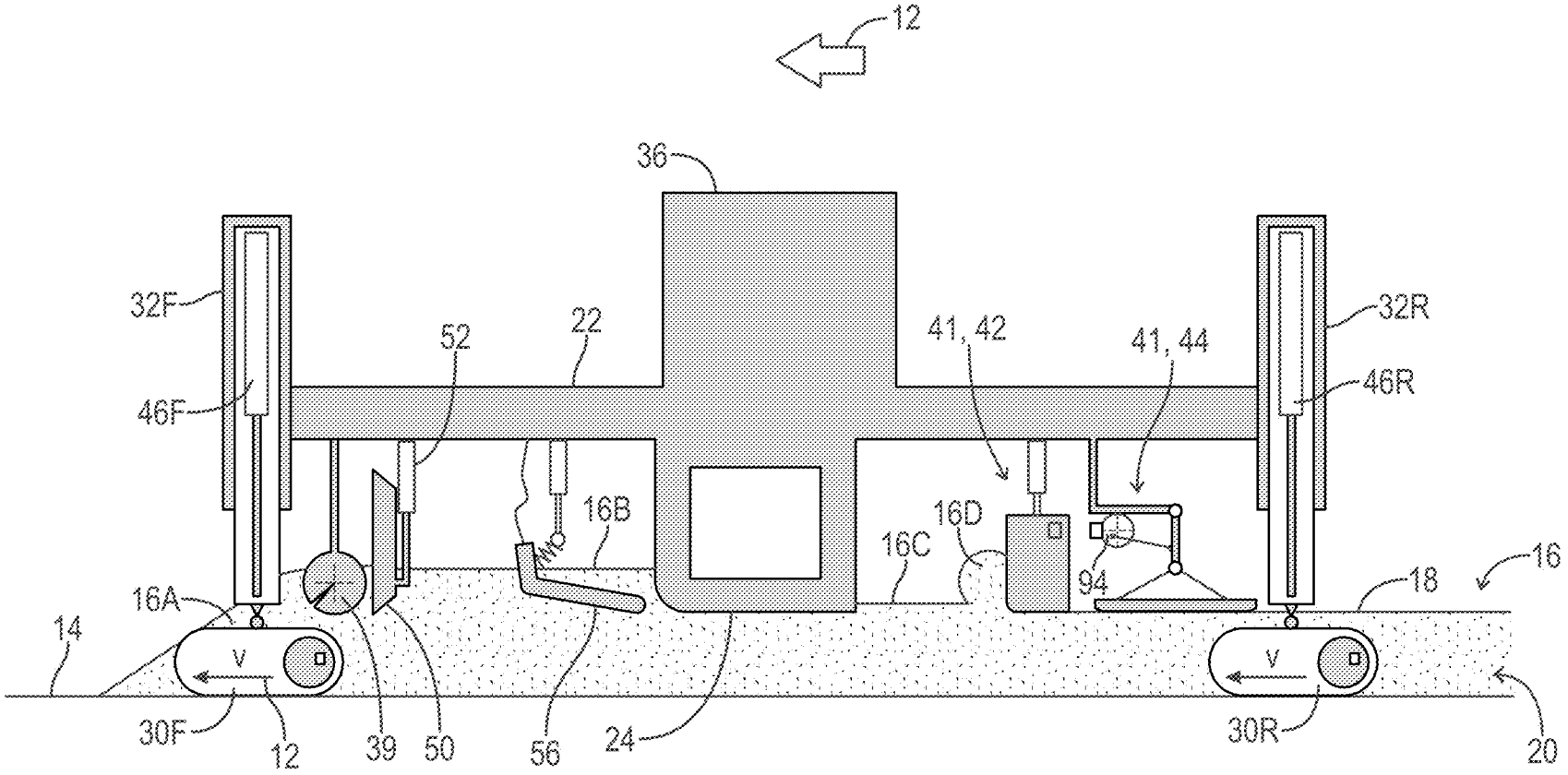
FIG. 2 is a schematic left side elevation view of the slip form paver of FIG. 1, but not including a dowel bar inserter.

It will be appreciated that many slip form pavers do not include the dowel bar inserter apparatus 40. The further schematic illustration of FIG. 2 shows the slip form paver machine 10 without the dowel bar inserter apparatus 40. If no dowel bar inserter apparatus 40 is used the transverse smoothing beam 42 and/or the longitudinal smoothing beam 44 may be provided behind the slip form paver mold 24.

Also, it will be appreciated that some slip form pavers do not include the transverse smoothing beam 42 and thus may include only the longitudinal smoothing beam 44. And some slip form pavers do not include the longitudinal smoothing beam 44 and thus may include only the transverse smoothing beam 42.

FIG. 2 schematically shows the slip form paving machine 10 including the transverse smoothing beam 42 and the longitudinal smoothing beam 44, but not including a dowel bar inserter 40. It will be understood that the dowel bar inserter 40 could be placed between the slip form mold 24 and the transverse smoothing beam 42.

In FIG. 2 the lifting columns 32 are designated as 32F and 32R for the front and rear lifting columns, respectively. The tracks 30 are designated as 30F and 30R for the front and rear tracks, respectively. It will be understood that there are two front lifting columns 32F on left and right sides of the machine 10, supporting the machine frame 22 from two front tracks 30F. Similarly, there are two rear lifting columns 32R supporting the machine frame 22 from two rear tracks 30R. In both FIGS. 1 and 2 the slip form paving machine 10 is illustrated as a four-track machine having front and rear tracked ground engaging units 30 on each of the left and right sides of the machine.

It will be understood that the various features disclosed herein are equally applicable to a two-track paving machine, such as for example the Wirtgen Model SP 62*i*, having one long crawler track on each of the left and right sides of the machine frame, with a front and a rear lifting column on each side of the machine frame supporting the machine frame from each of the two tracks. And it will be understood the various features disclosed herein are equally applicable to a three-track paving machine for example having a single track on one side and two tracks on the other side of the machine.

Each of the lifting columns 32F, 32R is constructed as a telescoping member and may include a hydraulic smart cylinder actuator such as 46F and 46R seen in FIG. 2. Extension and retraction of the actuators 46F and/or 46R causes extension and retraction of the lifting columns 32F and 32R and can raise or lower the machine frame 22 relative to the ground surface 14 and/or can adjust a longitudinal and/or transverse inclination of the machine frame 22 relative to the ground surface 14. Each of the hydraulic smart cylinders may include an integrated extension sensor to allow precise monitoring and control of the extension of the lifting columns 32. Optionally the lifting columns may include conventional hydraulic cylinders and separate associated extension sensors. Further optionally the lifting columns may have no extension sensors at all.

The plow or spreader device 38 identified in FIG. 1 is shown schematically in FIG. 2 as an auger type spreader device 39.

Behind the auger type spreader device 39 is a height adjustable concrete supply gate 50. The gate 50 is supported from the machine frame 22 by one or more gate actuators 52 for adjusting a height of the gate 50 relative to the machine frame 22. The gate actuators 52 may also be constructed as hydraulic smart cylinders having integrated extension sensors to allow precise monitoring and control of the extension of the height of the gate 50. Optionally the gate actuators 52 may include conventional hydraulic cylinders and may have separate associated extension sensors. Further optionally the gate actuators may have no extension sensors at all.

Between the gate 50 and the slip form mold 24 are a plurality of vibrators 56 which are configured to be submerged in the concrete mass from which the slab or structure 16 is formed to aid in compacting the concrete as the slip form mold 24 moves over the concrete mass.

In the paving process a mass of concrete material 16A is dumped on the ground surface 14 ahead of the paving machine 10. This is typically done with a series of dump trucks (not shown) dumping their loads of wet concrete onto the ground surface, so the supply of concrete material 16A occurs in a series of sequential dumps of material. Alternatively, the concrete mass may be supplied by a side feeder, a shuttle buggy, a placer-spreader or other known concrete supply means. The material 16A is spread transversely across the width of the paving machine 10 by the spreader device 38 or 39. The height of the concrete supply gate 50 is adjusted to control the amount of concrete material 16B directly in front of the slip form mold 24. With the aid of the vibrators 56 the concrete material is consolidated and semi-liquified and the slip form mold 24 moves across the concrete material 16B to form it into the concrete slab 16. Immediately behind the slip form mold 24 there may be some swelling in height of the newly formed slab in the area 16C. Immediately ahead of the transverse smoothing beam 42 a roll 16D of concrete material may form.

Figure 3:
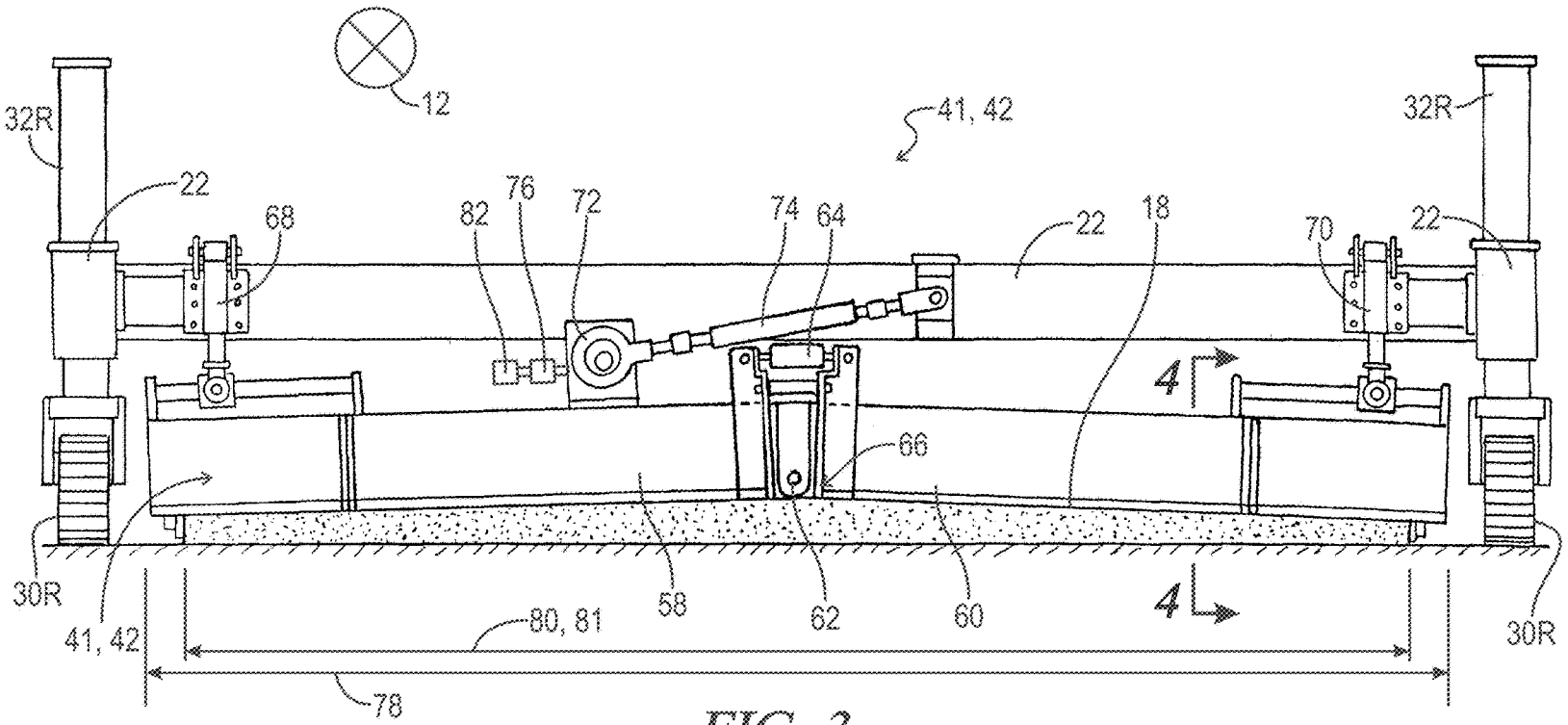
FIG. 3 is a schematic rear elevation view of a transverse smoothing beam.
Figure 4:
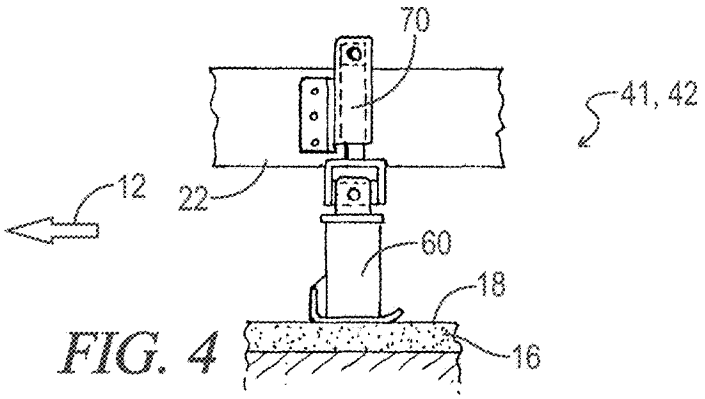
FIG. 4 is a left side elevation sectioned view of the transverse smoothing beam of FIG. 3 taken along line 4-4 of FIG. 3.

The transverse smoothing beam 42 is supported from the machine frame 22 behind the slip form mold 24 for engaging and oscillating transversely to the paving direction 12 upon the upper surface 18 of the formed not yet hardened concrete structure 16 to smooth the upper surface 18. FIGS. 3 and 4 illustrate one embodiment of the transverse smoothing beam 42. The transverse smoothing beam 42 includes first and second transverse smoothing beam members 58 and 60 pivotally connected together at pivot pin 62. A pivot actuator 64 allows the two members 58 and 60 of transverse smoothing beam 42 to be pivoted as shown in FIG. 3 to conform to a crown 66 in the upper surface 18 of the concrete structure 16. The outer end portions of the transverse smoothing beam 42 are slidably held in first and second adjustable vertical beam supports 68 and 70.

An eccentric drive 72 is mounted on the first beam member 58 of transverse smoothing beam 42. A push rod 74 connects the eccentric drive 72 to the main frame 22. A drive motor 76 drives the eccentric drive 72 to oscillate the transverse smoothing beam 42 left and right as seen in FIG. 3 relative to the main frame 22 and relative to the upper surface 18 of concrete structure 16 to smooth the upper surface 18. A transverse oscillation frequency sensor 82 may be associated with the drive motor 76. The transverse oscillation frequency sensor 82 may be configured to provide a transverse oscillation frequency signal 82S (See FIG. 7) corresponding to the frequency of transverse oscillation of the transverse smoothing beam 42. In one embodiment the transverse oscillation frequency sensor 82 may be configured to detect a rotational speed of the drive motor 76.

The slip form mold 24 can be described as having a mold width 80 which will also be equal to the width 81 of the concrete structure 16 formed by the mold 24, as seen in FIG. 3. As can also be seen in FIG. 3 the transverse smoothing beam 42 and particularly the first and second transverse beam members 58, 60 have an elongated shape with a longest dimension 78. The longest dimension 78 can be described as extending transversely across at least a majority of the mold width 80, and in the embodiment of FIG. 3 the longest dimension 78 is greater than the mold width 80 and concrete structure width 81.

Figure 5:
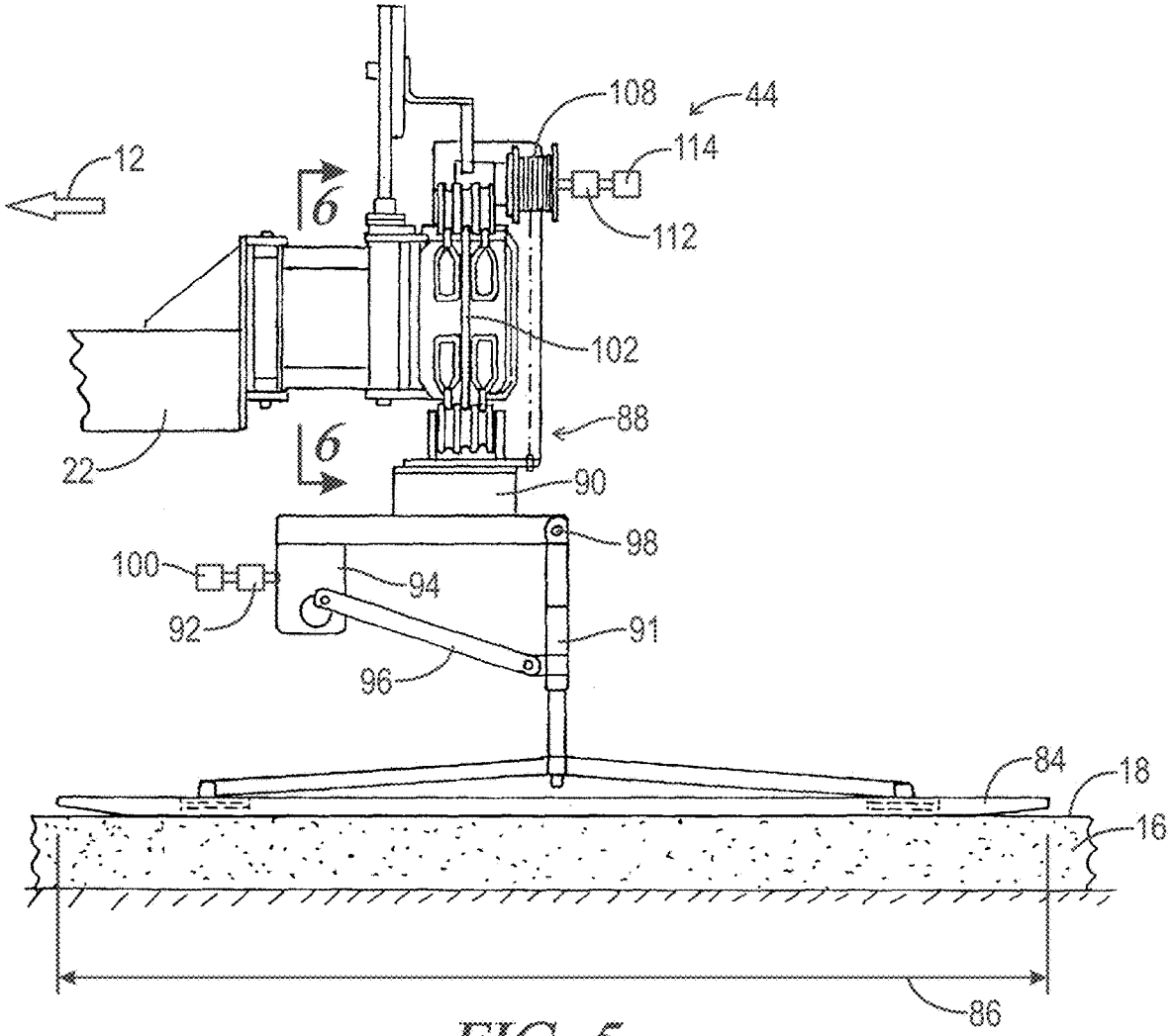
FIG. 5 is a schematic left side elevation view of a longitudinal smoothing beam and a portion of a main frame of the paving machine.
Figure 6:
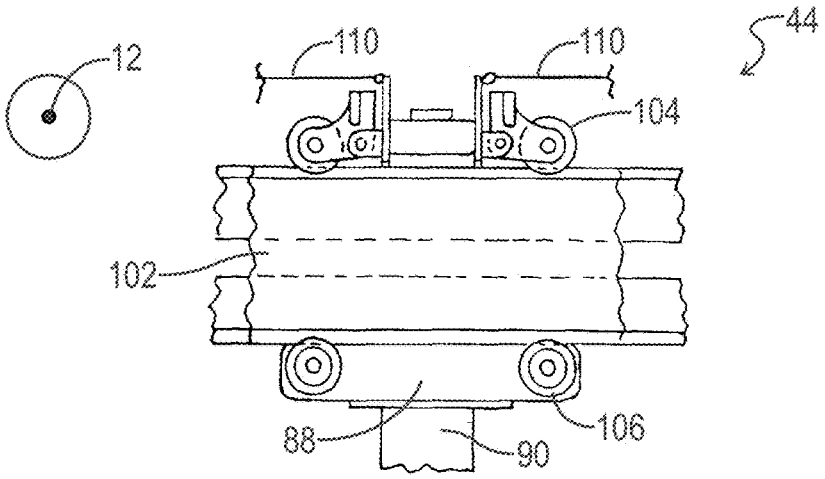
FIG. 6 is a front elevation view taken along line 6-6 of FIG. 5 showing a carriage of the longitudinal smoothing beam and a transverse beam on which the carriage travels.

The upper surface 18 may be further smoothed by the action of the longitudinal smoothing beam 44 which is a large automated smoothing trowel which moves transversely left and right across the width of the slab 16 while reciprocating forward and rearward. Details of construction of one embodiment of such a longitudinal smoothing beam 44 are shown in FIGS. 5 and 6. FIG. 5 is a schematic left side elevation view of the longitudinal smoothing beam 44 as supported by the main frame 22 of the paving machine 10. FIG. 6 is an enlarged front elevation view of a portion of FIG. 5 seen along line 6-6 of FIG. 5 and showing details of the carriage 88 and transverse beam 102 which are further described below.

The longitudinal smoothing beam 44 includes an elongated trowel 84 having a longest dimension 86 extending parallel to the paving direction 12. The trowel 84 is supported from a carriage 88 by a bracket 90 and a vertical leg 91. The vertical leg 91 is connected to bracket 90 at a pivotal connection 98. A drive motor 92 rotatably drives an eccentric drive 94 which is connected to vertical leg 91 by a drive link 96. The eccentric drive 94 oscillates the trowel 84 longitudinally parallel to advance direction 12 when rotated by the drive motor 92.

A longitudinal oscillation frequency sensor 100 is associated with drive motor 92 and is configured to provide a longitudinal oscillation frequency signal 100S (see FIG. 7) corresponding to the frequency of longitudinal oscillation of the trowel 84 of the longitudinal smoothing beam 44. The longitudinal oscillation frequency sensor 100 may be configured to detect a rotational speed of the drive motor 92.

The carriage 88 which carries the longitudinal smoothing beam 44 is arranged to move transversely across the width 81 of the concrete structure 16 on a transverse beam 102 which is in turn supported by the main frame 22 of the paving machine 10. The carriage 88 includes upper and lower wheels 104 and 106 riding on the transverse beam 102. At one or both ends of the transverse beam 102 a winch 108 may be attached to the carriage 102 by a cable 110. The carriage 88 and the longitudinal smoothing beam 44 are moved left and right across the width 81 of the concrete structure 16 by the winches 108. Each of the winches 108 may be driven by a winch drive motor 112. It will be appreciated that the speed of movement of the longitudinal smoothing beam 44 transversely across the width 81 of the concrete structure 16, and accordingly the frequency of movement left and right across the width 81, which may be referred to as a transverse oscillation frequency of the longitudinal smoothing beam 44, is determined by the rotational speed of the winches 108. A transverse oscillation frequency sensor 114 may be associated with each of the winch drive motors 112 and configured to provide a transverse oscillation frequency signal 114S (see FIG. 7) corresponding to the frequency of transverse oscillation of the longitudinal smoothing beam 44 left and right across the width 81 of the concrete structure 16. The transverse oscillation frequency sensor 114 may be configured to detect a rotational speed of its associated winch drive motor 112 and thus a rotational speed of its associated winch 108. It will be appreciated that the transverse oscillation frequency sensor 114 may also be considered to be detecting the transverse speed at which the carriage 88 and longitudinal smoothing beam 44 moves across the width 81 of the concrete structure 16, but since the distance to be traveled during one left and right cycle is constant (2 times the width 81), the transverse speed will be directly proportional to the transverse oscillation frequency, so the transverse oscillation frequency signal 114S directly corresponds to both transverse oscillation frequency and transverse speed of the longitudinal smoothing beam 44.

Further details of the mechanical construction of suitable embodiments of the transverse smoothing beam 42 and the longitudinal smoothing beam 44 are found in U.S. Pat. No. 6,471,442, assigned to the assignee of the present invention, the details of which are incorporated herein by reference.

Control System

Figure 7:
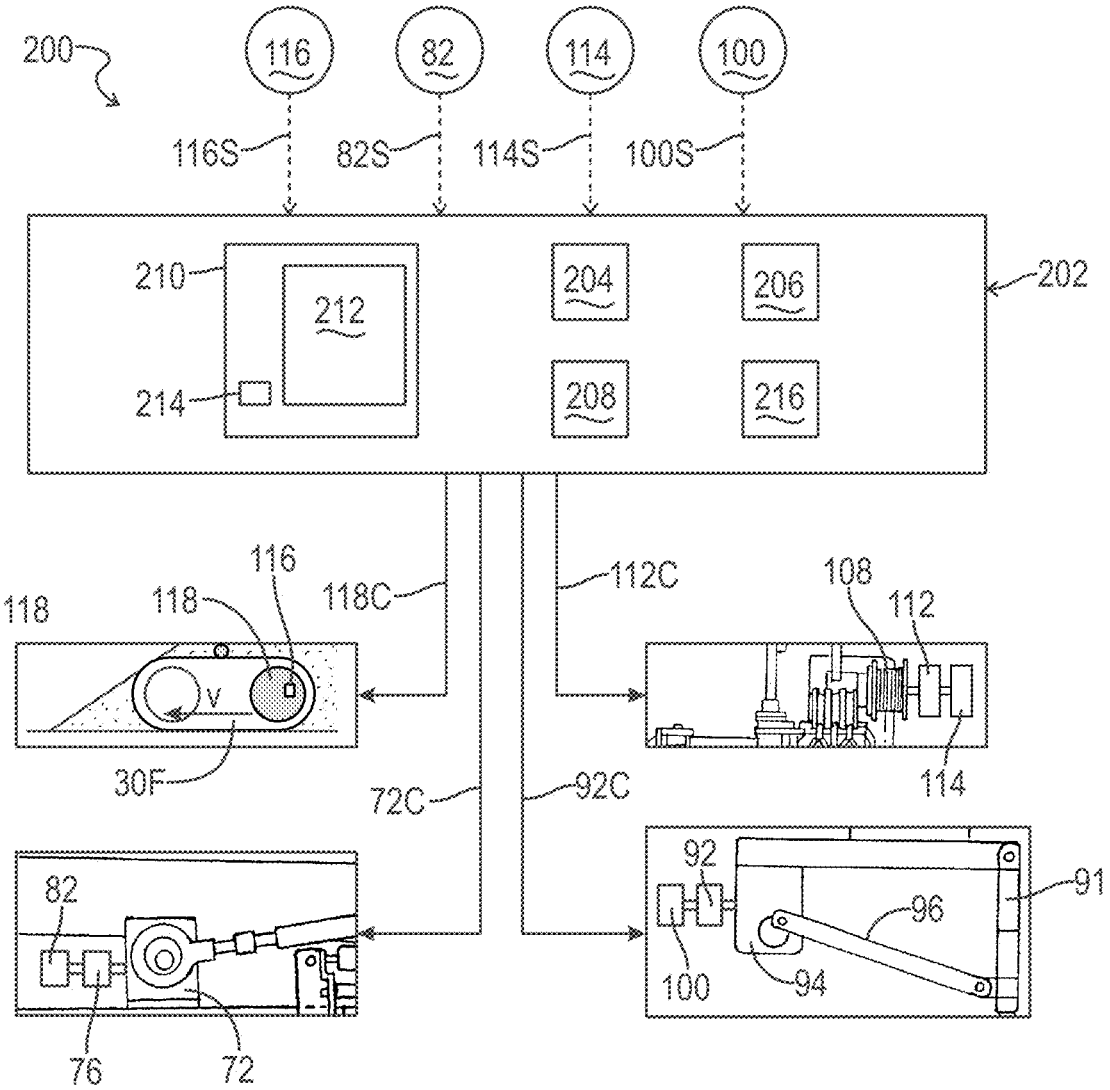
FIG. 7 is a schematic diagram of a control system of the paving machine showing the various sensor signal inputs and the various output commands to the various actuators of the paving machine.

As schematically illustrated in FIG. 7, the machine 10 includes a control system 200 including a controller 202. The controller 202 may be part of the machine control system of the slip form paver 10, or it may be a separate control module. The controller 202 may for example be mounted in a control panel located at the operator's station 36. The controller 202 is configured to receive input signals from the various sensors. The signals transmitted from the various sensors to the controller 202 are schematically indicated in FIG. 7 by lines connecting the sensors to the controller with an arrowhead indicating the flow of the signal from the sensor to the controller 202.

For example, controller 102 may receive an advance speed signal 116S from an advance speed sensor 116 corresponding to an advance speed of the paving machine 10 in the paving direction 12. The advance speed sensor 116 may for example be a rotary sensor associated with a rotary drive motor 118 (see FIG. 7) of one of the tracks 30 which drive the paving machine 10. Any other known advance speed sensor 116 could be used. For example, the advance speed sensor 116 may operate based upon Global Navigation Satellite System (GNSS) signals received by suitable position sensors carried by the paving machine 10. It will be appreciated that while there should be at least one advance speed sensor 116, there may be multiple advance speed sensors 116. For example, there may be one sensor 116 on a left side track and one on a right side track. Or each track may include an advance speed sensor 116 and the controller 202 may determine a mean value or take a smallest value of the readings in order to ignore slippage of the tracks.

The controller 202 may receive the transverse oscillating frequency signal 82S from the transverse oscillating frequency sensor 82 associated with the drive motor 76 of eccentric drive 72 of the transverse smoothing beam 42.

The controller 202 may receive transverse oscillating frequency signals 114S from the two transverse oscillating frequency sensors 114 associated with the winch drive motors 112 of the one or more winches 108 which drive the transverse oscillation of the longitudinal smoothing beam 44.

And the controller 202 may receive the longitudinal oscillating frequency signal 100S from the longitudinal oscillation frequency sensor 100 associated with the eccentric drive 94 of the longitudinal smoothing beam 44.

Similarly, the controller 202 will generate command signals for controlling the operation of the various drive motors discussed above, which control signals are indicated schematically in FIG. 7 by lines connecting the controller 202 to graphic depictions of the various drive motors and associated structures with the arrow indicating the flow of the command signal from the controller 202 to the respective drive motors. It will be understood that for control of a hydraulic drive motor the controller 202 may send an electrical signal to an electro/mechanical control valve (not shown) which controls flow of hydraulic fluid to and from the drive motor.

Controller 202 includes or may be associated with a processor 204, a computer readable medium 206, a data base 208 and an input/output module or control panel 210 having a display 212. An input/output device 214, such as a keyboard, joystick or other user interface, is provided so that the human operator may input instructions to the controller. It is understood that the controller 202 described herein may be a single controller having all of the described functionality, or it may include multiple controllers wherein the described functionality is distributed among the multiple controllers.

Various operations, steps or algorithms as described in connection with the controller 202 can be embodied directly in hardware, in a computer program product 216 such as a software module executed by the processor 204, or in a combination of the two. The computer program product 216 can reside in RAM memory, flash memory, ROM memory, EPROM memory, EEPROM memory, registers, hard disk, a removable disk, or any other form of computer-readable medium 206 known in the art. An exemplary computer-readable medium 206 can be coupled to the processor 204 such that the processor can read information from, and write information to, the memory/storage medium. In the alternative, the medium can be integral to the processor. The processor and the medium can reside in an application specific integrated circuit (ASIC). The ASIC can reside in a user terminal. In the alternative, the processor and the medium can reside as discrete components in a user terminal.

The term "processor" as used herein may refer to at least general-purpose or specific-purpose processing devices and/or logic as may be understood by one of skill in the art, including but not limited to a microprocessor, a microcontroller, a state machine, and the like. A processor can also be implemented as a combination of computing devices, e.g., a combination of a DSP and a microprocessor, a plurality of microprocessors, one or more microprocessors in conjunction with a DSP core, or any other such configuration.

The data storage in computer readable medium 206 and/or database 208 may in certain embodiments include a database service, cloud databases, or the like. In various embodiments, the computing network may comprise a cloud server, and may in some implementations be part of a cloud application wherein various functions as disclosed herein are distributed in nature between the computing network and other distributed computing devices. Any or all of the distributed computing devices may be implemented as at least one of an onboard vehicle controller, a server device, a desktop computer, a laptop computer, a smart phone, or any other electronic device capable of executing instructions. A processor (such as a microprocessor) of the devices may be a generic hardware processor, a special-purpose hardware processor, or a combination thereof.

Particularly the controller 202 may be programmed to receive the advance speed signal 116S, the transverse oscillation frequency signal 82S for the transverse smoothing beam 42, the transverse oscillation frequency signal 108S for the longitudinal smoothing beam 44, and the longitudinal oscillation frequency signal 100S for the longitudinal smoothing beam 44. And the controller 202 may be programmed to send command signal 118C to control the advance speed via drive motor 118, command signal 76C to control the transverse oscillation frequency of the transverse smoothing beam 42 via the drive motor 76 of eccentric drive 72, command signal 112C to control the transverse oscillation frequency of the longitudinal smoothing beam 44 via the one or more winch drive motors 112, and command signal 92C to control the longitudinal oscillation frequency of the longitudinal smoothing beam 44 via the drive motor 92 of eccentric drive 94. All of the command signals may be based at least in part on the advance speed signal and the respective oscillation frequency signals.

It will be appreciated that the oscillations of the transverse smoothing beam 42 and/or the longitudinal smoothing beam 44 upon the upper surface 18 of the newly formed concrete structure 16 as the paving machine 10 advances in the paving direction 12 will form patterns in the upper surface 18. The structure of these patterns is dependent upon the advance speed of the paving machine 10 and on the oscillation frequencies of the transverse smoothing beam 42 and/or the longitudinal smoothing beam 44. In prior art paving machines the oscillation frequencies of the transverse smoothing beam 42 and/or the longitudinal smoothing beam 44 are set manually and thus as the advance speed of the paving machine changes the patterns formed on the upper surface change. The present invention is directed to methods and apparatus for controlling the relationship between the advance speed and the oscillation frequencies of the transverse smoothing beam 42 and/or the longitudinal smoothing beam 44 so as to create constant patterns in the upper surface 18. This results in a more uniform finished surface which is desirable for both aesthetic reasons and quality control reasons.

Particularly the controller 202 may be configured via the computer program product 216 to generate the command signals so as to control a frequency of transverse oscillation of either of the transverse smoothing beam 42 or the longitudinal smoothing beam 44 such that a constant relationship is maintained between the advance speed and the frequency of transverse oscillation. The result of this constant relationship is that the associated smoothing beam 42 or 44 will form a constant surface pattern on the upper surface 18 of the concrete structure 16.

Figure 8:
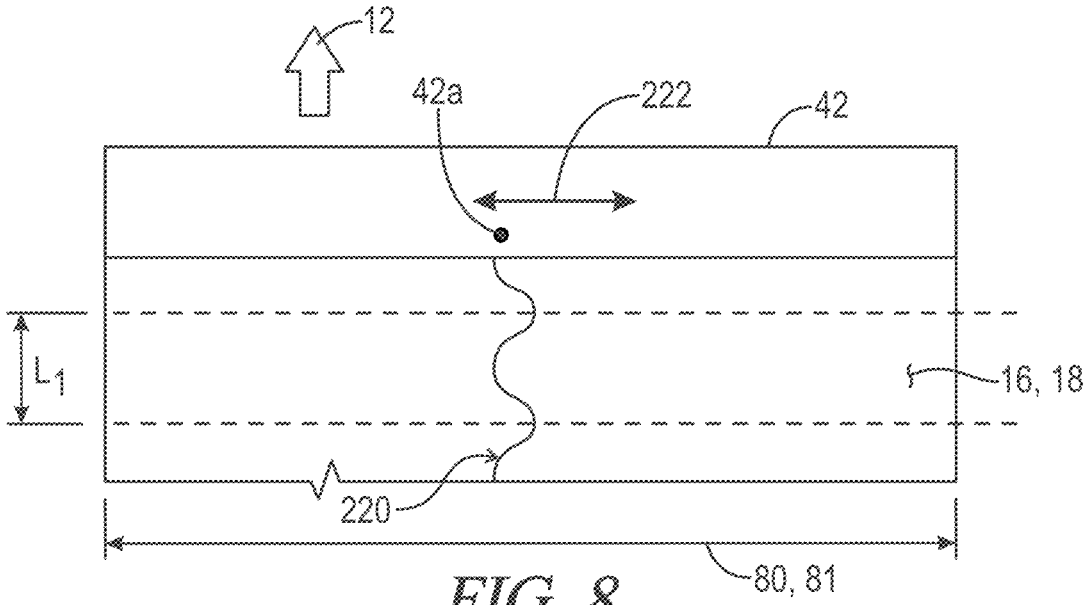
FIG. 8 is a schematic plan view of a constant surface pattern formed by the transverse smoothing beam.

This constant relationship and the resulting constant surface pattern for the transverse smoothing beam 42 is schematically illustrated in FIG. 8. In FIG. 8 a pattern 220 is schematically shown in the form of a sinusoidal structure with a wave length L1 produced by the transverse smoothing beam 42. The transverse smoothing beam 42 is oscillating left and right transversely to the advance direction 12 as indicated by the double headed arrow 222. Each point such as 42*a* on the surface of the underside of the transverse members 58, 60 of transverse smoothing beam 42 will form a sinusoidal pattern on the surface 18 with the wave length L1 being the distance traveled by the paving machine 10 during a single oscillation of the eccentric drive 72. It will be appreciated that the actual pattern 220 will not be a single sinusoidal line as shown in FIG. 8, but will be a multitude of parallel sinusoidal surface textures generally in a sinusoidal pattern as shown.

For example, the transverse smoothing beam may have a transverse oscillation frequency in the range of from about 0.5 to 2.0 cycles per second with a transverse movement generated by the eccentric drive 72 of a few inches. Typical paving speeds for the slip form paver machine 10 may range from 0 to 16 feet per minute (fpm) (0 to 490 centimeter per minute (cm/min)). For example at a transverse oscillation frequency of 1.0 cycle per second, and at an advance speed of 15 fpm (460 cm/min) the length L1 of the pattern 220 would be 3 inches (8 centimeters). By maintaining the constant relationship between the advance speed of the paving machine and the transverse oscillating frequency of the transverse smoothing beam 42, the distance L1 is maintained constant. If the advance speed decreases (or increases), the controller 202 will detect the change in advance speed and will decrease (or increase) the transverse oscillation frequency of the transverse smoothing beam 42 by commanding a corresponding reduction (or increase) in rotational speed of the drive motor 76 of the eccentric drive 72, so as to maintain the distance L1 as a constant value.

Figure 9:
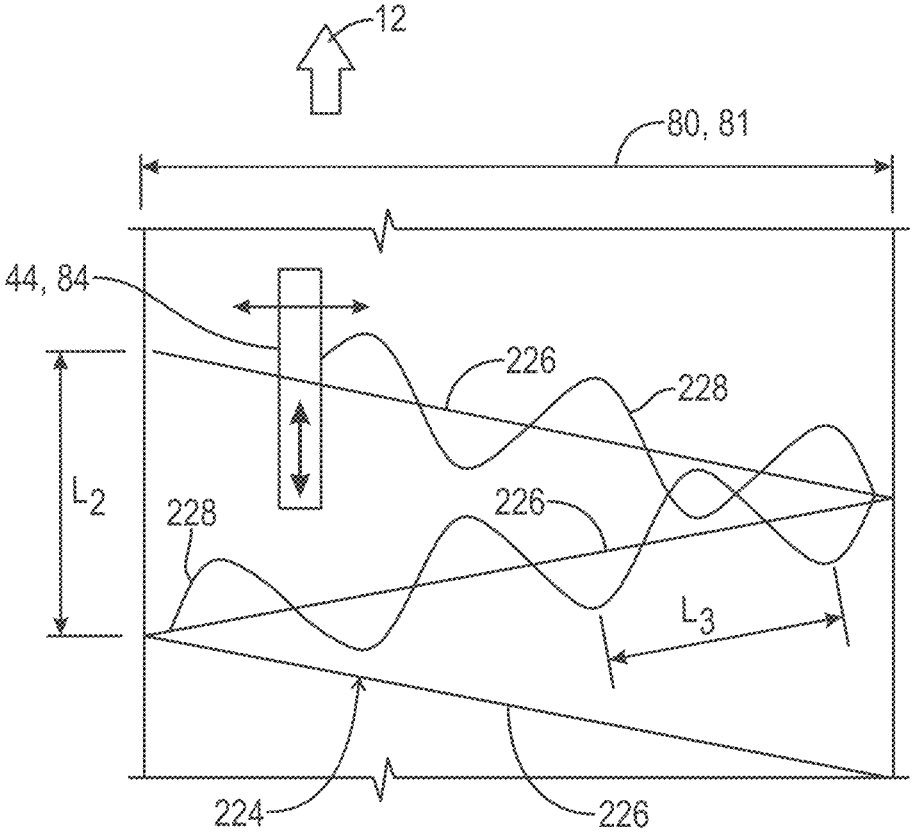
FIG. 9 is a schematic plan view of a constant surface pattern formed by the longitudinal smoothing beam.

The constant relationship and the resulting constant surface pattern 224 for the longitudinal smoothing beam 44 is schematically illustrated in FIG. 9. The FIG. 9 pattern 224 is more complex than the pattern of FIG. 8 because the longitudinal smoothing beam 44 is oscillating both transversely and longitudinally.

The pattern 224 of FIG. 9 includes a first zig-zag structure 226 having a wavelength L2. The wavelength L2 is the distance the paving machine 10 travels in the paving direction 12 while the carriage 88 of the longitudinal smoothing beam 44 moves from one edge of the concrete structure 16 to the other edge and back. The time for that one left and right movement of the carriage 88 will depend upon the speed of the winches 108 and the paving width 81 of the concrete structure. As previously noted the slip form paving machine 10 may have an adjustable width paving mold 24, but for any given paving job the mold width 80 and paving width 81 will be fixed. A paving machine such as the Wirtgen SP94 for example, can pave surfaces between 3.5 m (11.5 ft) and 9.5 m (31 ft) wide. The typical speed of the carriage 88 may for example be in a range of from 0.5 to 2.0 ft/sec (15 to 60 cm/s). Typical paving speeds for the slip form paver machine 10 range from 0 to 16 feet per minute (fpm) (0 to 490 centimeter per minute (cm/min)). For example at a carriage speed of 1 ft/sec (30 cm/sec) and a paving width of 15 ft (460 cm) it will take 30 sec for the carriage to move from one edge of the paving to the other and back. That is a frequency of 2 cycles per minute. At an advance speed of 15 fpm (3 inches per second) (460 cm/min (8 cm per second)) the length L2 of the pattern 224 would be 90 inches (7.5 ft) (230 cm). By maintaining the constant relationship between the advance speed of the paving machine and the transverse oscillating frequency of the longitudinal smoothing beam 44, the distance L2 is maintained constant. If the advance speed decreases (or increases), the controller 202 will detect the change in advance speed and will decrease (or increase) the transverse oscillation frequency of the longitudinal smoothing beam 44 by commanding a corresponding reduction (or increase) in rotational speed of the drive motor 112 of the winch 108. This will maintain the distance L2 as a constant value.

Each point on the surface of the underside of the longitudinal smoothing beam 44 will form a zig-zag pattern like 226 on the surface 18 with the wave length L2. It will be appreciated that the actual pattern 226 will not be a single zig-zag line as shown in FIG. 9, but will be a multitude of parallel zig-zag surface textures generally in a zig-zag pattern as shown.

The pattern 224 of FIG. 9 includes a second sinusoidal structure 228 superimposed on the first zig-zag structure 226 and having a wavelength L3. The wavelength L3 is dependent upon the transverse travel speed of the carriage 88 and upon the frequency of longitudinal oscillation of the eccentric drive 94 as detected by the longitudinal oscillation frequency sensor 100. Of course, as described above the transverse travel speed of the carriage 88 is adjusted dependent upon the advance speed of the paving machine 10, so the wavelength L3 may also be described as being dependent upon the advance speed of the paving machine 10 and upon the frequency of oscillation of the eccentric drive 94. The longitudinal smoothing beam 44 may have a longitudinal oscillation frequency in the range of from about 0.5 to 2.0 cycles per second with a longitudinal movement generated by the eccentric drive 94 of a few inches. For example, at a transverse carriage speed of 1 ft/sec (30 cm/sec) and a longitudinal oscillation frequency of 1.0 cycle per second the distance L3 will be 1 ft (30 cm). For a paving width 81 of 15 ft (460 cm) the transverse carriage speed of 1 ft/sec (30 cm/sec) corresponds to a transverse oscillation frequency of the longitudinal smoothing beam 44 of 2 cycles per minute. By maintaining the constant relationship between the advance speed of the paving machine and the longitudinal oscillating frequency of the longitudinal smoothing beam 44, the distance L3 is maintained constant. If the advance speed decreases (or increases), the controller 202 will detect the change in advance speed and will decrease (or increase) the longitudinal oscillation frequency of the longitudinal smoothing beam 44 by commanding a corresponding reduction (or increase) in rotational speed of the drive motor 92 of the eccentric drive 94. This will maintain the distance L3 at a constant value.

Each point on the surface of the underside of the longitudinal smoothing beam 44 will form a sinusoidal pattern like 228 on the surface 18 with the wave length L3. It will be appreciated that the actual pattern 228 will not be a single sinusoidal line as shown in FIG. 9 but will be a multitude of parallel sinusoidal surface textures generally in a sinusoidal pattern as shown.

It will be appreciated that the paving machine 10 may be set up initially for a given paving job with historically preferred parameters for advance speed of the paving machine, transverse speed of the carriage 88, and oscillation frequencies of the eccentric drives 72 and 94. For those initial settings, if the advance speed is maintained constant, then uniform patterns such as 220 and 224 would occur. But in a real-life paving situation it is not always possible to maintain a constant advance speed of the paving machine 10. Adjustments in advance speed may be required for many reasons, such as changing characteristics of the incoming concrete material being provided at location 16A (see FIG. 2), changing environmental conditions, or the like. With prior art paving machines any change in advance speed will result in a change in the resulting surface patterns created by the transverse smoothing beam 42 and/or the longitudinal smoothing beam 44. With the systems of the present invention, however, the controller 202 can monitor the advance speed via advance speed sensor 116 and can generate command signals to control the frequency of oscillation of the transverse smoothing beam 42 and/or the longitudinal smoothing beam 44 so that a constant relationship is maintained between the advance speed and the frequency of oscillation of the transverse smoothing beam 42 and/or the longitudinal smoothing beam 44. For the longitudinal smoothing beam 44 this includes control of both the frequency of transverse oscillation and the frequency of longitudinal oscillation.

For example, a method of operating the slip form paving machine 10 may be described as comprising steps of:

(a) molding a mass of concrete 16A, 16B with the slip form mold 24 to form a not yet hardened concrete structure 16 as the paving machine 10 moves forward in a paving direction 12;

(b) engaging an upper surface 18 of the not yet hardened concrete structure 16 with at least one smoothing beam 42, 44 supported behind the slip form mold 24 and oscillating the at least one smoothing beam 42, 44 transversely to the paving direction 12 to smooth the upper surface 18;

(c) monitoring an advance speed of the slip form paving machine with a controller 202; and (d) automatically controlling with the controller 202 a frequency of transverse oscillation of the at least one smoothing beam 42, 44 such that a constant relationship is maintained between the advance speed and the frequency of transverse oscillation thereby forming a constant surface pattern 220, 224 on the upper surface 18 of the not yet hardened concrete structure 16.

In the situation where the at least one smoothing beam 41 further includes a longitudinal smoothing beam 44, step (b) may include oscillating the longitudinal smoothing beam 44 parallel to the paving direction 12 while the longitudinal smoothing beam 44 oscillates transversely to the paving direction 12, and step (d) may include automatically controlling with the controller 202 a frequency of longitudinal oscillation of the longitudinal smoothing beam such that a constant relationship is maintained between the advance speed and the frequency of longitudinal oscillation.

Thus, it is seen that the apparatus and methods of the present disclosure readily achieve the ends and advantages mentioned as well as those inherent therein. While certain preferred embodiments of the disclosure have been illustrated and described for present purposes, numerous changes in the arrangement and construction of parts and steps may be made by those skilled in the art, which changes are encompassed within the scope and spirit of the present disclosure as defined by the appended claims. Each disclosed feature or embodiment may be combined with any of the other disclosed features or embodiments.

What is claimed is:

1. A slip form paving machine, comprising:

a machine frame;

a plurality of ground engaging wheels or tracks for supporting the machine frame from a ground surface;

a slip form mold supported from the machine frame for molding a mass of concrete into a formed not yet hardened concrete structure as the paving machine moves forward in a paving direction, the slip form mold having a mold width extending transversely to the paving direction;

at least one smoothing beam supported behind the slip form mold for engaging an upper surface of the formed not yet hardened concrete structure to smooth the upper surface, the at least one smoothing beam being configured to oscillate transversely to the paving direction;

at least one advance speed sensor configured to provide an advance speed signal corresponding to an advance speed of the slip form paving machine in the paving direction; and a controller configured to receive the advance speed signal and to generate a command signal to control a frequency of transverse oscillation of the at least one smoothing beam such that a constant relationship is maintained between the advance speed and the frequency of transverse oscillation.

2. The machine of claim 1, wherein:

the at least one smoothing beam includes a transverse smoothing beam having an elongated shape with a longest dimension extending transversely across at least a majority of the mold width.

3. The machine of claim 2, further comprising:

a transverse oscillation frequency sensor configured to provide a transverse oscillation frequency signal corresponding to the frequency of transverse oscillation of the transverse smoothing beam.

4. The machine of claim 3, further comprising:

a drive motor rotatably driving an eccentric drive connected to the transverse smoothing beam to generate the transverse oscillation of the transverse smoothing beam; and wherein the transverse oscillation frequency sensor is configured to detect a rotational speed of the drive motor.

5. The machine of claim 2, wherein:

the at least one smoothing beam further includes a longitudinal smoothing beam having an elongated shape with a longest dimension extending parallel to the paving direction.

6. The machine of claim 5, wherein:

the longitudinal smoothing beam also oscillates parallel to the paving direction while it oscillates transversely to the paving direction; and the controller is further configured to generate a command signal to control a frequency of longitudinal oscillation of the longitudinal smoothing beam such that a constant relationship between the advance speed and the frequency of longitudinal oscillation is maintained.

7. The machine of claim 1, wherein:

the at least one smoothing beam includes a longitudinal smoothing beam having an elongated shape with a longest dimension extending parallel to the paving direction.

8. The machine of claim 7, wherein:

the longitudinal smoothing beam also oscillates parallel to the paving direction while it oscillates transversely to the paving direction; and the controller is further configured to generate a command signal to control a frequency of longitudinal oscillation of the longitudinal smoothing beam such that a constant relationship is maintained between the advance speed and the frequency of longitudinal oscillation.

9. The machine of claim 8, further comprising:

a transverse oscillation frequency sensor configured to provide a transverse oscillation frequency signal corresponding to the frequency of transverse oscillation of the longitudinal smoothing beam;

a longitudinal oscillation frequency sensor configured to provide a longitudinal oscillation frequency signal corresponding to the frequency of longitudinal oscillation of the longitudinal smoothing beam; and wherein the controller is further configured to receive the transverse oscillation frequency signal and the longitudinal oscillation frequency signal.

10. The machine of claim 9, further comprising:

at least one winch configured to pull a carriage carrying the longitudinal smoothing beam left and right across the mold width; and wherein the transverse oscillation frequency sensor is configured to detect a rotational speed of the at least one winch.

11. The machine of claim 9, further comprising:

a drive motor rotatably driving an eccentric drive connected to the longitudinal smoothing beam to generate the longitudinal oscillation of the longitudinal smoothing beam; and wherein the longitudinal oscillation frequency sensor is configured to detect a rotational speed of the drive motor.

12. The machine of claim 1, further comprising:

a transverse oscillation frequency sensor configured to provide a transverse oscillation frequency signal corresponding to a frequency of transverse oscillation of the at least one smoothing beam.

13. The machine of claim 1, wherein:

the mold width of the slip form mold is an adjustable mold width.

14. A method of operating a slip form paving machine including a slip form mold, the method comprising:

(a) molding a mass of concrete with the slip form mold to form a not yet hardened concrete structure as the paving machine moves forward in a paving direction;

(b) engaging an upper surface of the not yet hardened concrete structure with at least one smoothing beam supported behind the slip form mold and oscillating the at least one smoothing beam transversely to the paving direction to smooth the upper surface;

(c) monitoring an advance speed of the slip form paving machine with a controller; and (d) automatically controlling with the controller a frequency of transverse oscillation of the at least one smoothing beam such that a constant relationship is maintained between the advance speed and the frequency of transverse oscillation thereby forming a constant surface pattern on the upper surface of the not yet hardened concrete structure.

15. The method of claim 14, wherein:

in step (b) the at least one smoothing beam includes a transverse smoothing beam having an elongated shape with a longest dimension extending transversely across at least a majority of a mold width of the slip form mold.

16. The method of claim 15, wherein:

in step (b) the at least one smoothing beam further includes a longitudinal smoothing beam having an elongated shape with a longest dimension extending parallel to the paving direction, the longitudinal smoothing beam being located behind the transverse smoothing beam.

17. The method of claim 16, wherein:

step (b) further includes oscillating the longitudinal smoothing beam parallel to the paving direction while the longitudinal smoothing beam oscillates transversely to the paving direction; and step (d) further includes automatically controlling with the controller a frequency of longitudinal oscillation of the longitudinal smoothing beam such that a constant relationship is maintained between the advance speed and the frequency of longitudinal oscillation.

18. The method of claim 14, wherein:

in step (b) the at least one smoothing beam includes a longitudinal smoothing beam having an elongated shape with a longest dimension extending parallel to the paving direction.

19. The method of claim 18, wherein:

step (b) further includes oscillating the longitudinal smoothing beam parallel to the paving direction while the longitudinal smoothing beam oscillates transversely to the paving direction; and step (d) further includes automatically controlling with the controller a frequency of longitudinal oscillation of the longitudinal smoothing beam such that a constant relationship is maintained between the advance speed and the frequency of longitudinal oscillation.

* * * * *